US011427980B1

(12) United States Patent
Kimrey

(10) Patent No.: US 11,427,980 B1
(45) Date of Patent: Aug. 30, 2022

(54) ASSEMBLY AND METHOD FOR INSTALLING AND REPLACING FENCE POSTS

(71) Applicant: Tyler Blake Kimrey, Jenks, OK (US)

(72) Inventor: Tyler Blake Kimrey, Jenks, OK (US)

( * ) Notice: Subject to any disclaimer, the term of this patent is extended or adjusted under 35 U.S.C. 154(b) by 0 days.

(21) Appl. No.: 17/368,312

(22) Filed: Jul. 6, 2021

Related U.S. Application Data

(60) Provisional application No. 63/048,755, filed on Jul. 7, 2020.

(51) Int. Cl.
*E04H 17/22* (2006.01)
*E02D 11/00* (2006.01)
*E02D 27/42* (2006.01)

(52) U.S. Cl.
CPC ..... *E02D 11/00* (2013.01); *E02D 27/42* (2013.01); *E04H 17/22* (2013.01); *E02D 2200/1607* (2013.01)

(58) Field of Classification Search
CPC ..... E04H 17/009; E04H 17/22; E02D 11/00; E02D 27/42; E01F 3/026
See application file for complete search history.

(56) References Cited

U.S. PATENT DOCUMENTS 1,095,197 A * 5/1914 Entenmann ..... E04H 12/2276 52/297
1,564,109 A * 12/1925 Ponsolle ..... E04H 12/2276 52/297
3,403,520 A * 10/1968 Goodman ..... E04H 12/2292 405/303
5,752,349 A * 5/1998 Fitzsimmons ..... A63B 71/023 52/165
6,389,760 B1 * 5/2002 McDonnell ..... E04H 12/2292 52/165
7,357,738 B2 * 4/2008 White ..... A63B 71/023 473/481
7,954,289 B2 * 6/2011 Evans ..... E01F 9/685 403/374.1
8,011,149 B2 * 9/2011 Knudsen ..... E04B 1/92 52/165
8,522,503 B1 * 9/2013 Egan, Jr. ..... E04H 12/2292 52/294
8,572,905 B1 * 11/2013 Driggers ..... E02D 27/42 52/298
8,875,469 B1 * 11/2014 Keller, Sr. ..... E02D 5/60 52/165
10,006,178 B2 * 6/2018 Intagliata ..... E01F 9/629
10,801,230 B2 * 10/2020 Durrant ..... E04H 12/2269
(Continued)

*Primary Examiner* — Benjamin F Fiorello
(74) *Attorney, Agent, or Firm* — Dennis D. Brown; Brown Patent Law, P.L.L.C.

(57) ABSTRACT

An assembly and method for installing a fence post and cementing the fence post in place which allows the fence post to later be replaced without digging the old post and cement out of the ground and without having to re-cement and position the new fence post. The assembly includes an outer sleeve which is cemented in the post hole, an insert which receives a lower end of the fence post and is inserted into the outer sleeve, and an upper cap, through which the post extends, which is threadedly secured on the outer sleeve and is configured, and/or includes a ratcheting latch or strap, for releasably compressing an upper end of the insert into gripping engagement with the fence post.

19 Claims, 3 Drawing Sheets

(56) References Cited

U.S. PATENT DOCUMENTS

2007/0170412 A1* 7/2007 Lee ..... E04H 12/2269
256/59
2010/0146875 A1* 6/2010 Redding ..... E04H 12/2292
52/170

* cited by examiner

ASSEMBLY AND METHOD FOR INSTALLING AND REPLACING FENCE POSTS

RELATED CASE

This application claims the benefit of U.S. Provisional Patent Application Ser. No. 63/048,755 filed on Jul. 7, 2020 and incorporates said provisional application by reference into this document as if fully set out at this point.

FIELD OF THE INVENTION

The present invention relates to an assembly and method for removably installing a fence post in the ground and for subsequently replacing the fence post.

BACKGROUND OF THE INVENTION

Currently, vertical posts for most types of fences are installed by (a) digging a series of holes in the ground which are the proper depth and are in the proper alignment, (b) placing the lower ends of the posts in the holes, (c) at least partially filling the holes with cement, (d) positioning the posts in their correct vertical orientations, and (e) allowing the cement to dry.

Unfortunately, when installed in this manner, the fence posts are very difficult to replace when they are old, or if they are damaged or broken by storms, collisions, abuse, or other events. To remove an old post, the lower end of the post and the cement in which it is encased must be dug out of the ground. Then, to replace the old post with a new post, the original installation procedure must essentially be repeated.

Consequently, a need exists for a new assembly and method which can be used for removably installing fence posts such that, (a) when replacing the fence posts with new fence posts, the old fence posts can be removed without digging the old posts and cement out of the ground and (b) the new fence posts can be installed and retained in proper alignment without repeating the original cementing and positioning procedures.

SUMMARY OF THE INVENTION

The present invention provides a fence post installation assembly, as well as a method for installing and replacing fence posts, which satisfy the needs and alleviate the problems discussed above. The inventive assembly and method can be used for metal fence posts, wooden fence posts, fence posts formed of pipe segments, or fence posts formed of composite materials, plastics, or any other materials used in the art.

In one aspect, there is provided an assembly which preferably comprises: an insert for receiving the lower end of a fence post; an outer sleeve into which the insert is inserted; an upper cap which is rotatably positioned around the fence post and is threadedly tightened onto the upper end of the outer sleeve; and a ratcheting latch or strap which is retained in and/or around the cap for releasably tightening the strap around the fence post.

In another aspect, there is provided a method for installing a fence post which preferably comprises the steps of: (a) securing the inventive assembly on the lower end portion of the fence post; (b) placing the lower end portion of the fence post, with the inventive assembly secured thereon, in a hole in the ground; (c) filling the hole with cement up to a level which is preferably below the upper cap of the inventive assembly; and (d) positioning the fence post in its correct vertical orientation and allowing the cement to harden.

At a later time subsequent to installing the fence post, the method for replacing the fence post preferably comprises the steps of: (i) removing dirt from around the fence post down to a level below the ratcheting latch or strap; (ii) loosening the ratcheting latch or strap; (iii) pulling the old fence post out of the inventive assembly, which remains cemented in the ground; (iv) inserting the lower end portion of a new fence post into the inventive assembly; and (v) tightening the ratcheting latch or strap around the new fence post.

In another aspect, there is provided an assembly for replaceably installing a fence post. The assembly preferably comprises: an outer sleeve, an insert, and an upper cap. The outer sleeve preferably comprises: (i) an open upper end. (ii) an internal cavity which extends downwardly from the open upper end of the outer sleeve to a lower end of the internal cavity, (iii) an upwardly facing radial shoulder provided around the open upper end, and (iv) external threads which surround the open upper end. The insert preferably comprises: (i) an open upper end, (ii) a downwardly facing exterior radial shoulder provided at or below the open upper end of the insert, and (iii) an internal cavity for receiving a lower end portion of the fence post, the internal cavity of the insert extending downwardly from the open upper end of the insert to a lower end of the internal cavity of the insert. The upper cap preferably comprises: (i) internal threads which are threadedly connectable with the external threads of the outer sleeve and (ii) an opening through the cap for receiving the fence post and for rotating the upper cap around the fence post when threadedly connecting, tightening, loosening, or disconnected the upper cap on the outer sleeve. The insert is preferably receivable in the internal cavity of the outer sleeve to a depth that the downwardly facing exterior radial shoulder of the insert rests on the upwardly facing radial shoulder of the outer sleeve. The upper cap preferably holds the downwardly facing exterior radial shoulder of the insert in contact with the upwardly facing radial shoulder of the outer sleeve when the upper cap is threadedly connected to the outer sleeve.

In another aspect, there is provided a method for fencing comprising the steps of: (a) placing a lower end portion of a fence post in an internal cavity of an insert; (b) before or after step (a) inserting the insert into an internal cavity of an outer sleeve such that a compressible upper portion of the insert projects from an open upper end of the outer sleeve, the outer sleeve having external threads which surround the open upper end of the outer sleeve; (c) before or after step (a) and before or after step (b), inserting an end of the fence post through an opening of an upper cap, the upper cap having internal threads; (d) before or after step (c), rotating the upper cap to threadedly connect the internal threads of the upper cap to the external threads of the outer sleeve; (e) using the cap to releasably compress the compressible upper portion of the insert into gripping contact with the fence post; and (f) cementing the lower end portion of the fence post, having the insert, the outer sleeve, and the upper cap thereon, in a post hole by filling the post hole which cement to a level which covers at least most of the outer sleeve but is below the upper cap.

In another aspect, there is provided a method of fencing which preferably comprises the steps oft (a) placing a lower end portion of a fence post in an internal cavity of an insert, the internal cavity extending downwardly from an open upper end of the insert to a lower end of the cavity and the insert having a downwardly facing exterior radial shoulder provided at or below the open upper end of the insert; (b) before or after step (a), inserting the insert into an internal cavity of an outer sleeve, the internal cavity of the outer sleeve extending downwardly from an open upper end of the outer sleeve to a lower end of the internal cavity of the outer sleeve, the outer sleeve having external threads which surround the open upper end of the outer sleeve, and the outer sleeve also having an upwardly facing shoulder provided at the open upper end of the outer sleeve upon which the downwardly facing exterior radial shoulder of the insert rests when the insert is inserted into the internal cavity of the outer sleeve; (c) before or after step (a) and before or after step (b), inserting an end of the fence post through an opening of an upper cap, the upper cap having internal threads; (d) before or after step (c), rotating the upper cap to threadedly connect the internal threads of the upper cap to the external threads of the outer sleeve and to threadedly tighten the upper cap on the outer sleeve so that the upper cap holds the downwardly facing exterior radial shoulder of the insert in contact with the upwardly facing radial shoulder of the outer sleeve; (e) cementing the lower end portion of the fence post, having the insert, the outer sleeve, and the upper cap thereon, in a post hole by filling the post hole which cement to a level which covers at least most of the outer sleeve but is below the upper cap; and (t) at least partially filling an upper portion of the post hole above the level of the cement with dirt.

Further aspects, features, and advantages of the present invention will be apparent to those in the art upon examining the accompanying drawings and upon reading the following detailed description of the preferred embodiments.

DETAILED DESCRIPTION OF THE PREFERRED EMBODIMENTS

Figure 1:
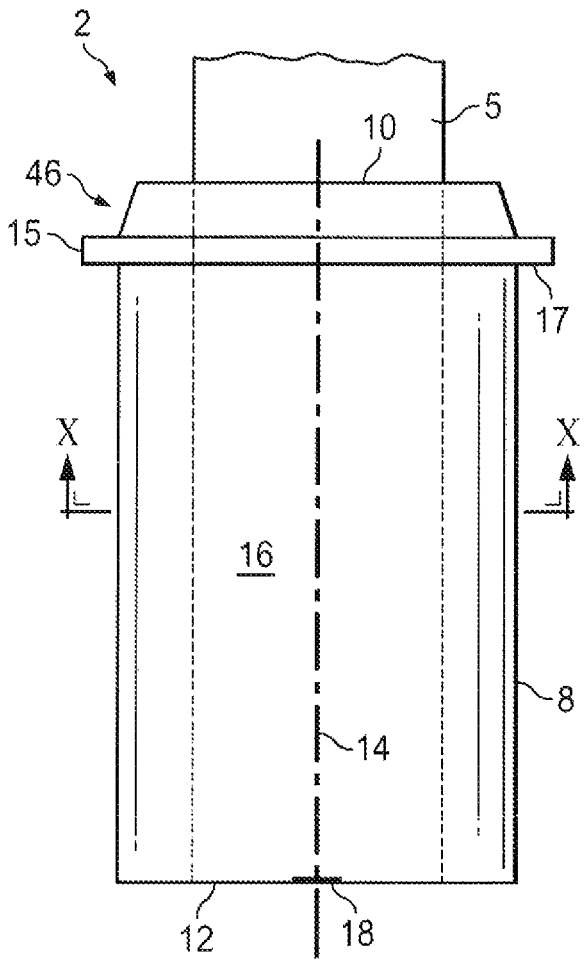
FIG. 1 is an elevational side view of an insert 2 used in a first embodiment of the assembly for installing a fence post provided by the present invention.

A first embodiment of the inventive fence post installation assembly is illustrated in FIGS. 1-6. The inventive assembly comprises: an insert 2 in which the lower end of the fence post 5 is received; an outer sleeve 4 into which the insert 2 is inserted; and an upper cap 6 for the outer sleeve 4.

The insert 2 preferably comprises: a cylindrical outer surface 8; an open upper end 10; a bottom wall 12; a longitudinal axis 14 which extends through the insert 2; an outwardly extending radial lip 15 at or below (preferably below) the open upper end 10 of the insert 2; a downwardly facing exterior radial shoulder 17 provided by the outwardly extending radial lip 15; an elongate internal cavity 16, for receiving the lower end of the fence post 5, which extends from the open upper end 10 of the insert 2 to the bottom wall 12; and an air hole 18 provided in the bottom wall 12 for draining the cavity 16 if needed and/or to relieve suction conditions in the cavity 16 which might otherwise occur when attempting to remove the lower end of the fence post 5 from the cavity 16.

Figure 2:
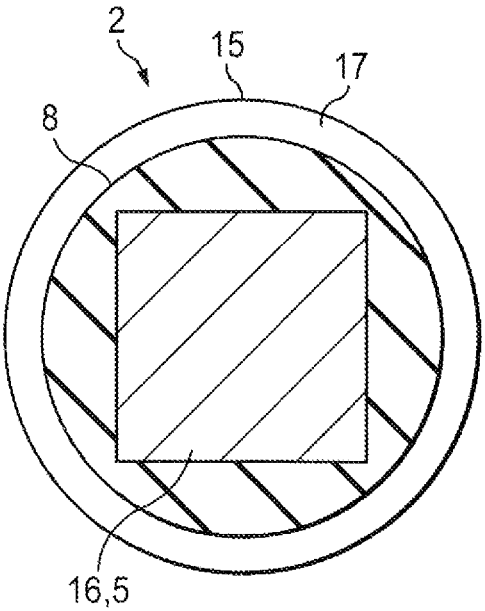
FIG. 2 is a cutaway view of an embodiment of the insert 2 for a square fence post 5 as seen from perspective x-x shown in FIG. 1.
Figure 3:
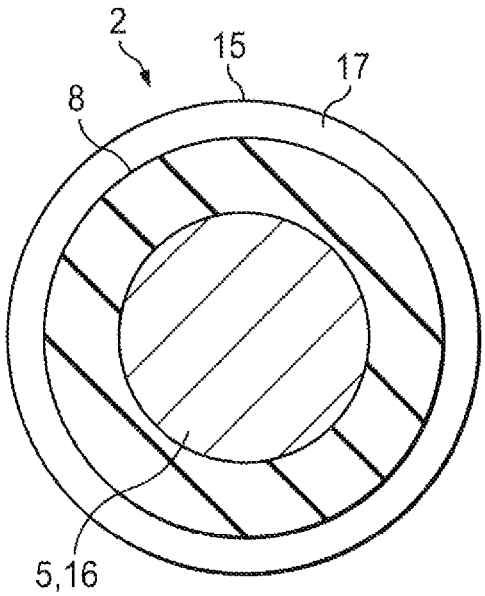
FIG. 3 is a cutaway view of an embodiment of the insert 2 for a round fence post 5 as seen from perspective x-x shown in FIG. 1.
Figure 4:
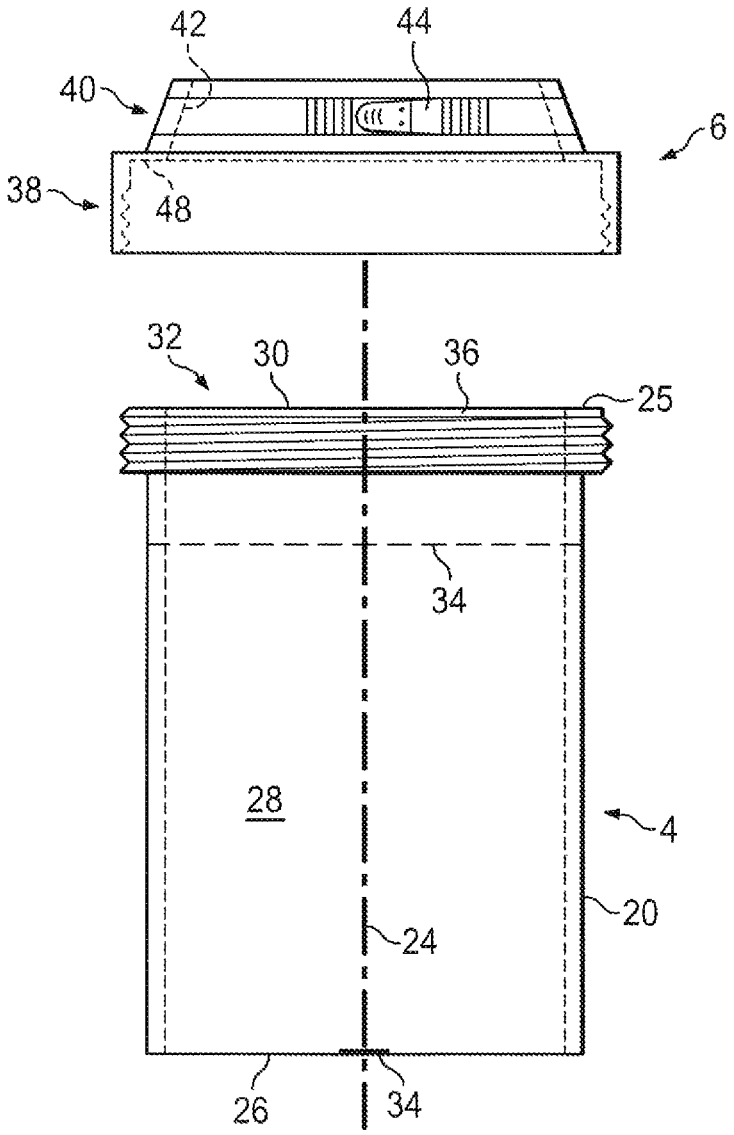
FIG. 4 is an exploded elevational view of an outer sleeve 4 and an upper cap 6 used in the first embodiment of the inventive assembly.
Figure 5:
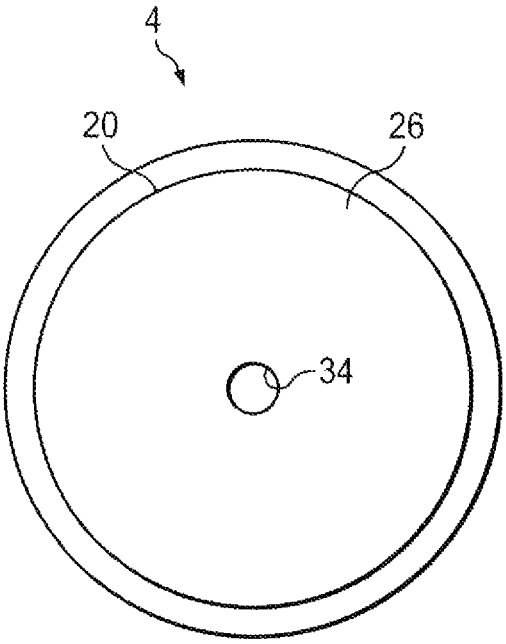
FIG. 5 is a bottom view of the outer sleeve 4.
Figure 6:
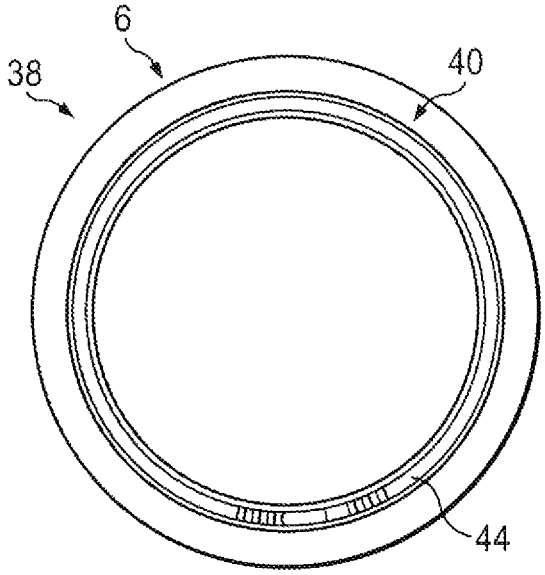
FIG. 6 is a top view of the upper cap 6.

The lateral cross-sectional shape and size of the cavity 16 of the insert 2 will preferably correspond to the cross-sectional shape (circular or non-circular) and size of the fence post 5 such that a reasonably snug, but easily insertable and removable fit for the fence post 5 is provided. Consequently, by way of example but not by way of limitation, if the fence post 5 is round, the cross-sectional shape of the cavity 16 will preferably be circular as illustrated in FIG. 3. On the other hand, if the fence post 5 is square, the cross-sectional shape of the cavity 16 will preferably also be square as illustrated in FIG. 2.

The height of the insert 2 will preferably be in the range of from about 22 to about 24 inches and will more preferably be in the range of from about 23 to about 24 inches.

The outer sleeve 4 of the inventive assembly preferably comprises: a cylindrical body 20; a radially extending, externally threaded flange 22 on the upper end of the cylindrical body 20; an upwardly facing shoulder 25 provided by the upper end of the outer sleeve 4 and/or the externally threaded flange 22; a longitudinal axis 24 which extends through the outer sleeve 4; a bottom wall 26; a cylindrical internal cavity 28, for receiving the insert 2, which has an open upper end 30 and extends downwardly into the sleeve 4 from the upper end 32 of the sleeve 4 to the bottom wall 26; an air hole 34 provided in the bottom wall 26 of the sleeve 4 for draining the cylindrical internal cavity 28 if needed and/or to relieve suction conditions in the cavity 28 which might otherwise occur when attempting to remove the insert 2 from the cavity 28; and a fill line or other indicia 34 on the exterior of the cylindrical body 20 below the threaded flange 22 which indicates an upper limit for filling the post hole, in which the outer sleeve 4 has been placed, with cement.

The cylindrical internal cavity 28 of the outer sleeve 4 is preferably sized for receiving the insert 2 such that (a) the bottom end 12 of the insert 2 will contact or will be in close proximity to the bottom wall 26 of the sleeve 4 and (b) the downwardly facing exterior radial shoulder 17 of the outwardly extending radial lip 15 of the insert 2 will rest on the upwardly facing exterior shoulder 25 at the upper end of the outer sleeve 4. The vertical distance from the bottom 26 of the outer sleeve 4 to the fill line 34 will preferably be in the range of from about 18 to about 21 inches. The vertical distance from the bottom 26 of the outer sleeve 4 to the fill line 34 will more preferably be in the range of from about 19 to about 20 inches.

The upper cap 6 of this embodiment of the inventive assembly preferably comprises: an internally threaded lower segment 38 which is threadedly receivable on the externally threaded upper flange 22 of the outer sleeve 4; an upper segment 40 of the cap 6 which extends upwardly from the internally threaded lower segment 38; a circular opening 42 which is provided through the upper segment 40 and is sized for receiving the fence post 5 and for allowing the cap 6 to be rotated around the fence post 5 when threadedly attaching the cap 6 to, or removing the cap 6 from, the upper end of the outer sleeve 4; and a ratcheting latch or strap 44, retained in and/or around the upper segment 40 of the cap 6, for releasably tightening around the fence post 5. The upper segment 40 of the cap 6 preferably has a tapered and/or conical interior and exterior shape such that the upper segment 40 of the cap 6 converges inwardly as it extends upwardly. The insert 2 also preferably includes a compressible upper end segment 46 above the radial lip 15 which has a corresponding tapered and/or conically shaped exterior surface which nests inside the tapered and/or conically shaped upper segment 40 of the cap 6 when the cap 6 is threadedly connected to the outer sleeve 4.

When the upper cap 6 is threadedly connected to the outer sleeve 4, the upper cap 6 holds the downwardly facing exterior radial shoulder 17 of the insert 2 in contact with the upwardly facing shoulder 25 of the outer sleeve 4.

The insert 2, the outer sleeve 4, and the cap 6 can each be formed of a plastic, a metal, or any other material which is suitable for use below ground over several years. The tapered and/or conically shaped upper segment 40 of the cap 6 and the tapered and/or conically shaped upper end portion 46 of the insert 2 will preferably be formed of a compressible material such that the upper segment 40 of the cap 6 and the upper end portion 46 of the insert 2 can be compressed into tight engagement around the fence post 5 when the ratcheting latch or strap 44 is tightened. The insert 2 will preferably be formed of rubber and/or silicone. The outer sleeve 4 will preferably be formed of a plastic and/or recycled material, such as a hardened plastic. The cap 6 will preferably be formed of a plastic and/or recycled material, such as a hardened plastic.

Although the order of the steps can be varied to some degree, in an embodiment of the inventive the method for installing a fence post 5 using the first embodiment of the inventive assembly, the cap 6 is preferably first positioned around a mid-portion of the post 5. Next, the lower end portion of the fence post 5 is inserted into the internal cavity 16 of the insert 2 such that the bottom end of the fence post 5 contacts the bottom wall of the insert 2. The insert 2 and the lower end portion of the fence post 5 are then inserted into the cylindrical internal cavity 28 of the outer sleeve 4 such that the downwardly facing exterior radial shoulder 17 of the exterior radial lip 15 of the insert 2 abuts the upwardly facing shoulder 25 of the outer sleeve 4. Next, the cap 6, which is already positioned around the fence post 5, is threadedly attached to the externally threaded upper flange 22 of the outer sleeve 4 such that the exterior radial lip 15 of the insert 2 is clamped between an interior radial shoulder 48 of the cap 6 and the upwardly facing shoulder 25 of the outer sleeve 4. The ratcheting latch or strap 44 is then tightened securely around the fence post 5 to releasably compress the compressible upper segment 46 of the insert 2 into gripping contact around the fence post 5.

After the inventive assembly is secured on the lower end of the fence post 5, the lower end of the post 5 is placed in the ground in a post hole of appropriate depth (preferably about 24 inches) and diameter (preferably about 8 inches). The post hole is then filled with cement up to the fill line 34 provided on the outer sleeve 4, which prevents the cement from contacting and hardening around the cap 6 and the ratcheting latch or strap 44. Once the cement is in place and the fence post 5 is positioned in its correct vertical orientation, the cement is allowed to harden. The remainder of the post hole above the cement can then be filled with dirt.

Subsequently, at a later time when it is desired or necessary to replace the first fence post 5, the dirt in the upper portion of the post hole around the lower end portion of the first fence post 5 need only be removed down to a level below the ratcheting latch or strap 44. Once the ratcheting latch or strap 44 is uncovered, the ratcheting latch or strap 44 can be loosened such that the first post 5 can simply be pulled out of the inventive assembly, which preferably remains cemented in the ground, and the lower end portion of a new fence post 5 can be inserted. The ratcheting latch or strap 44 is then tightened around the new fence post 5, to releasably compress the compressible upper segment 46 of the insert 2 into gripping contact around the new fence post 5, and the upper portion of the inventive assembly can again be re-covered with dirt.

Figure 7:
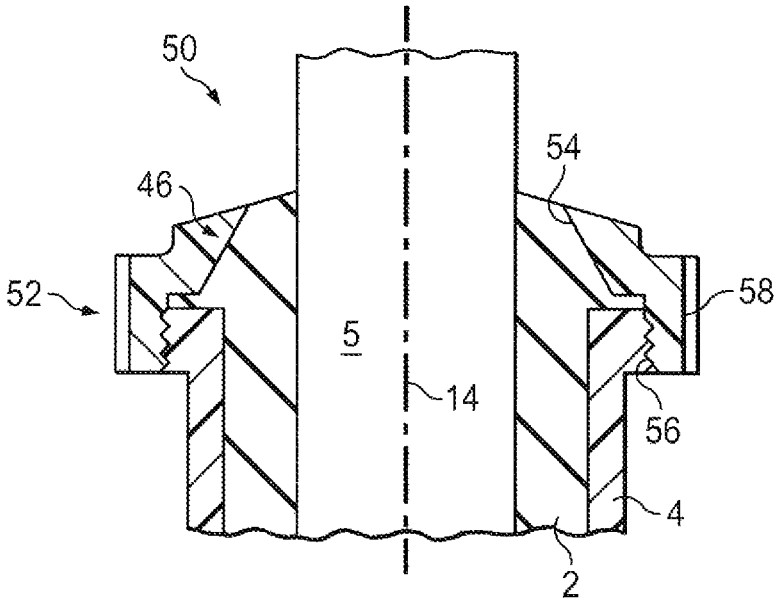
FIG. 7 is an elevational cutaway side view of an alternative embodiment 50 of the assembly for installing a fence post provided by the present invention.

A second embodiment 50 of the inventive fence post installation assembly is illustrated in FIG. 7. The second embodiment 50 of the inventive assembly is substantially the same as the first embodiment shown in FIGS. 1-6 except that, rather than using a ratcheting latch or strap 44, the upper cap 52 of the inventive assembly 50 comprises a tapered interior surface 54, above the internal threads 56 of the cap 52, which converges inwardly, as it extends upwardly, at an angle wherein, as the cap 52 is tightened on the outer sleeve 4, the tapered interior surface 54 contacts and compresses the compressible upper segment 46 of the insert 2 inwardly (i.e., toward the longitudinal axis 14 of the insert 2) into a gripping engagement with the fence post 5. Raise ribs 58 and/or other gripping features are also preferably provided around the cap 52 to provide a better grip for tightening or loosening the cap 52 on the outer sleeve 4 by hand.

When using the embodiment 50 of the inventive assembly for installing and later replacing a fence post 5, the method of the present invention is also substantially the same as described above except that: (i) rather than using a ratcheting latch or strap 44, the threaded tightening of the upper cap 52 on the outer sleeve 4 not only holds the downwardly facing exterior radial shoulder 17 of the insert 2 in contact with the upwardly facing shoulder 25 of the outer sleeve 4 but also compresses the compressible upper segment 46 of the insert 2 inwardly (i.e., toward the longitudinal axis 14 of the insert 2) into a gripping engagement with the fence post 5; (ii) when later replacing the fence post 5, the dirt in the upper portion of the post hole will be removed down to a level below the upper cap 52; (iii) the upper cap 52 will then be threadedly loosened or removed (preferably just sufficiently loosened) to release the gripping contact of the compressible upper segment 46 of the insert 2 around the fence post 5; and (iv) after removing the old fence post 5 and inserting the lower end portion of the replacement fence post 5, the upper cap 52 will be threadedly tightened on the outer sleeve 4, which remains cemented in the ground, to releasably compress the upper segment 46 of the insert 2 inwardly into gripping contact around the replacement fence post 5.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art.

What is claimed is:

1. An assembly for replaceably installing a fence post comprising:

an outer sleeve comprising (i) an open upper end, (ii) an internal cavity which extends downwardly from the open upper end of the outer sleeve to a lower end of the internal cavity, (iii) an upwardly facing shoulder provided the open upper end, and (iv) external threads which surround the open upper end;

an insert comprising (i) an open upper end, (ii) a downwardly facing exterior radial shoulder provided at or below the open upper end of the insert, and (iii) an internal cavity for receiving a lower end portion of the fence post, the internal cavity of the insert extending downwardly from the open upper end of the insert to a lower end of the internal cavity of the insert;

an upper cap comprising (i) internal threads which are threadedly connectable with the external threads of the outer sleeve and (ii) an opening through the cap for receiving the fence post and for rotating the upper cap around the fence post when threadedly connecting, tightening, loosening, or disconnecting the upper cap on or from the outer sleeve;

the insert being receivable in the internal cavity of the outer sleeve to a depth that the downwardly facing exterior radial shoulder of the insert rests on the upwardly facing shoulder of the outer sleeve; and the upper cap holding the downwardly facing exterior radial shoulder of the insert in contact with the upwardly facing shoulder of the outer sleeve when the upper cap is threadedly connected to the outer sleeve.

2. The assembly of claim 1 further comprising:

the downwardly facing exterior radial shoulder of the insert being positioned below the open upper end of the insert;

the insert comprising a compressible upper segment above the downwardly facing exterior radial shoulder; and the compressible upper segment of the insert being inwardly compressible, for gripping the fence post, when the insert is received in the internal cavity of the outer sleeve and the upper cap is threadedly connected to the outer sleeve.

3. The assembly of claim 2 further comprising a ratcheting latch or strap provided in and/or around the upper cap which releasably compresses the compressible upper segment of the insert inwardly, for gripping the fence post, when (i) the insert is received in the internal cavity of the outer sleeve, (ii) the upper cap is threadedly connected to the outer sleeve, and (iii) the ratcheting latch or strap is tightened.

4. The assembly of claim 2 further comprising the upper cap having a tapered interior surface above the internal threads of the upper cap, the tapered interior surface of the upper cap converging inwardly as it extends upwardly, and the tapered interior surface of the upper cap contacting and compressing the compressible upper segment of the insert inwardly, for gripping the fence post, when the insert is received in the internal cavity of the outer sleeve and the upper cap is threadedly tightened onto the outer sleeve.

5. The assembly of claim 2 further comprising:

the upper cap having a tapered interior surface above the internal threads, the tapered interior surface of the upper cap converging inwardly as it extends upwardly;

the compressible upper segment of the insert having a tapered exterior surface which converges inwardly as it extends upwardly; and the tapered interior surface of the upper cap contacting the tapered exterior surface of the compressible upper segment of the insert when the insert is received in the internal cavity of the outer sleeve and the upper cap is threadedly tightened onto the outer sleeve.

6. The assembly of claim 1 further comprising:

the insert having a circular exterior cross-sectional shape and the internal cavity of the insert having a non-circular cross-sectional shape for receiving the fence post when the fence post has a non-circular cross-sectional shape.

7. The assembly of claim 6 further comprising the opening through the upper cap for receiving and rotating the upper cap around the fence post being a circular opening.

8. The assembly of claim 1 further comprising a hole in the lower end of the internal cavity of the insert for draining the internal cavity of the insert and/or for relieving suction conditions in the internal cavity of the insert when removing the lower end portion of the fence post from the internal cavity of the insert.

9. A method for fencing comprising the steps of:

a) placing a lower end portion of a fence post in an internal cavity of an insert;

b) before or after step (a), inserting the insert into an internal cavity of an outer sleeve such that a compressible upper portion of the insert projects from an open upper end of the outer sleeve, the outer sleeve having external threads which surround the open upper end of the outer sleeve;

c) before or after step (a) and before or after step (b), inserting an end of the fence post through an opening of an upper cap, the upper cap having internal threads;

d) before or after step (c), rotating the upper cap to threadedly connect the internal threads of the upper cap to the external threads of the outer sleeve;

e) using the cap to releasably compress the upper compressible upper portion of the insert into gripping contact with the fence post; and f) cementing the lower end portion of the fence post, having the insert, the outer sleeve, and the upper cap thereon, in a post hole by filling the post hole which cement to a level which covers at least most of the outer sleeve but is below the upper cap.

10. The method of claim 9 further comprising:

the upper cap comprises a ratcheting latch or strap provided in and/or around the upper cap and step (e) comprises tightening the ratcheting latch or strap around the compressible upper portion of the insert to releasably compress the compressible upper portion of the insert into gripping contact around the fence post.

11. The method of claim 9 further comprising:

the upper cap having a tapered interior surface above the internal threads of the upper cap, the tapered interior surface of the upper cap converging inwardly as it extends upwardly and step (e) comprises threadedly tightening the upper cap on the outer sleeve so that the tapered interior surface of the upper cap contacts the compressible upper portion of the insert and releasably compresses the compressible upper portion of the insert inwardly into gripping contact around the fence post.

12. A method for fencing comprising the steps of:

a) placing a lower end portion of a fence post in an internal cavity of an insert, the internal cavity extending downwardly from an open upper end of the insert to a lower end of the internal cavity and the insert having a downwardly facing exterior radial shoulder provided at or below the open upper end of the insert;

b) before or after step (a) inserting the insert into an internal cavity of an outer sleeve, the internal cavity of the outer sleeve extending downwardly from an open upper end of the outer sleeve to a lower end of the internal cavity of the outer sleeve, the outer sleeve having external threads which surround the open upper end of the outer sleeve, and the outer sleeve also having an upwardly facing shoulder provided at the open upper end of the outer sleeve upon which the downwardly facing exterior radial shoulder of the insert rests when the insert is inserted into the internal cavity of the outer sleeve;

c) before or after step (a) and before or after step (b), inserting an end of the fence post through an opening of an upper cap, the upper cap having internal threads;

d) before or after step (c), rotating the upper cap to threadedly connect the internal threads of the upper cap to the external threads of the outer sleeve and to threadedly tighten the upper cap on the outer sleeve so that the upper cap holds the downwardly facing exterior radial shoulder of the insert in contact with the upwardly facing shoulder of the outer sleeve; and e) cementing the lower end portion of the fence post, having the insert, the outer sleeve, and the upper cap thereon, in a post hole by filling the post hole which cement to a level which covers at least most of the outer sleeve but is below the upper cap.

13. The method of claim 12 further comprising:

the downwardly facing exterior radial shoulder of the insert being positioned below the open upper end of the insert;

the insert comprising a compressible upper segment above the downwardly facing exterior radial shoulder; and the compressible upper segment of the insert being inwardly compressible to grip the fence post.

14. The method of claim 13 further comprising:

the upper cap having a ratcheting latch or strap provided in and/or around the upper cap and the method further comprising the step, after step (d), of tightening the ratcheting latch or strap around the compressible upper segment of the insert to releasably compress the compressible upper segment (if the insert into gripping contact around the fence post.

15. The method of claim 14 further comprising the step, after step (e), of at least partially filling an upper portion of the post hole above the level of the cement with dirt.

16. The method of claim 15 further comprising the steps of:

removing the dirt from the post hole down to a level below the ratcheting latch or strap;

loosening or releasing the ratcheting latch or strap to release the gripping contact of the compressible upper segment of the insert around the fence post;

pulling the lower end portion of the fence post out of the insert with the outer housing, the insert, the upper cap, and the cement remaining in the post hole;

inserting a lower end portion of a replacement fence post through the opening of the upper cap and into the insert; and tightening the ratcheting latch or strap around the compressible upper segment of the insert to releasably compress the compressible upper segment of the insert into gripping contact around the replacement fence post.

17. The method of claim 13 further comprising:

the upper cap having a tapered interior surface above the internal threads of the upper cap, the tapered interior surface of the upper cap converging inwardly as it extends upwardly and the method further comprising threadedly tightening the upper cap on the outer sleeve so that the tapered interior surface of the upper cap contacts the compressible upper segment of the insert and releasably compresses the compressible upper segment of the insert inwardly into gripping contact around the fence post.

18. The method of claim 17 further comprising the step, after step (e), of at least partially filling an upper portion of the post hole above the level of the cement with dirt.

19. The method of claim 18 further comprising the steps of:

removing the dirt from the post hole down to a level below the upper cap;

threadedly loosening the upper cap on or threadedly releasing the upper cap from the outer housing to release the gripping contact of the compressible upper segment of the insert around the fence post;

pulling the lower end portion of the fence post out of the insert with at least the outer housing and the cement remaining in the post hole;

inserting a lower end portion of a replacement fence post into the insert; and threadedly tightening the upper cap on the outer sleeve, with the insert and the lower end portion of the replacement fence post positioned in the outer sleeve, to releasably compress the compressible upper segment of the insert inwardly into gripping contact around the replacement fence post.

* * * * *